US008899728B2

(12) United States Patent
Nishimura et al.

(10) Patent No.: US 8,899,728 B2
(45) Date of Patent: Dec. 2, 2014

(54) DROPLET DISCHARGE HEAD AND IMAGE-FORMING APPARATUS INCLUDING A FIRST AND SECOND SUBSTRATE THE SECOND SUBSTRATE INCLUDING THREE PLATES

(71) Applicants: Hideaki Nishimura, Atsugi (JP); Yukitoshi Tajima, Zama (JP); Takafumi Sasaki, Atsugi (JP)

(72) Inventors: Hideaki Nishimura, Atsugi (JP); Yukitoshi Tajima, Zama (JP); Takafumi Sasaki, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/949,589

(22) Filed: Jul. 24, 2013

(65) Prior Publication Data

US 2014/0028756 A1 Jan. 30, 2014

(30) Foreign Application Priority Data

Jul. 26, 2012 (JP) ..... 2012-165453

(51) Int. Cl.
*B41J 2/045* (2006.01)
*B41J 2/14* (2006.01)

(52) U.S. Cl.
CPC ..... *B41J 2/14* (2013.01); *B41J 2002/14362* (2013.01); *B41J 2/14233* (2013.01)
USPC ..... 347/68; 347/70; 347/71

(58) Field of Classification Search
CPC ..... B41J 2/14145; B41J 2/14201; B41J 2/14233; B41J 2/14032; B41J 2/14048
USPC ..... 347/20, 44, 47, 63, 65, 67–68, 70–71
See application file for complete search history.

(56) References Cited

U.S. PATENT DOCUMENTS

| | | | | |
|---|---|---|---|---|
| 7,934,813 | B2 * | 5/2011 | Owaki et al. | 347/68 |
| 2002/0005879 | A1 | 1/2002 | Kitahara | |
| 2003/0117463 | A1 | 6/2003 | Kitahara | |
| 2013/0021412 | A1 | 1/2013 | Nishimura et al. | |
| 2013/0070021 | A1 | 3/2013 | Nishimura et al. | |

FOREIGN PATENT DOCUMENTS

JP 2003-053966 2/2003

OTHER PUBLICATIONS

Sol-Gel Processing of $Pbtio_3$, $PbzrO_3$, PZT, and PLZT Thin Films, K.D. Budd, S.K. Dey, D. A. Payne, Proc. Brit. Ceram. Soc. 36, 107 (1985).
U.S. Appl. No. 13/770,383, filed Feb. 19, 2013.

* cited by examiner

*Primary Examiner* — Juanita D Jackson
(74) *Attorney, Agent, or Firm* — Oblon, Spivak, McClelland, Maier & Neustadt, L.L.P.

(57) ABSTRACT

A droplet discharge head includes a nozzle plate provided with a nozzle opening which discharges an ink drop, an actuator substrate which forms a pressurized liquid chamber communicating with the nozzle opening, and is provided with a pressure generator changing a pressure in the pressured liquid chamber, and a common liquid chamber-forming substrate which forms a common liquid chamber to which ink which is supplied to the pressurized liquid chamber is supplied, the common liquid chamber-forming substrate includes a first plate made of a metal material, a second plate made of a resin material provided on one surface of the first plate, and a third plate made of a resin material provided on the other surface of the first plate, and the first plate, the second plate, and the third plate being integrally molded in a thickness direction.

16 Claims, 5 Drawing Sheets

DROPLET DISCHARGE HEAD AND IMAGE-FORMING APPARATUS INCLUDING A FIRST AND SECOND SUBSTRATE THE SECOND SUBSTRATE INCLUDING THREE PLATES

PRIORITY CLAIM

The present application is based on and claims priority from Japanese Patent Application No. 2012-165453, filed on Jul. 26, 2012, the disclosure of which is hereby incorporated by reference in its entirety.

BACKGROUND

1. Field of the Invention

The present invention relates to a droplet discharge head which discharges liquid from a nozzle opening and an image-forming apparatus.

2. Description of the Related Art

An ink jet recorder including a droplet discharge head which discharges droplets of ink, for example, is known as an image-forming apparatus such a printer, fax machine, copier, plotter, or complex machine in which some of these are combined. The ink jet recorder is configured to form an image by adhering ink drops to a sheet while feeding a medium. The medium here is not limited to a sheet, and can be a medium to be recorded, recording medium, transfer material, recording sheet or the like. Moreover, the image-forming apparatus is intended to be an apparatus which discharges liquid to a medium such as paper, string, fiber, fabric, leather, metal, plastic, glass, wood, or ceramics to form an image. The image-formation is intended not only to apply an image having characters, shapes or the like to a medium but also to apply an image without having a pattern or the like to a medium (to simply discharge droplets). The term ink is not limited to so-called ink, and it can be used as a generic name of liquid including, for example, a DNA sample, resist, or pattern material as long as it becomes liquid when it is discharged.

The ink jet recorder includes an ink jet head. In this ink jet head, a liquid chamber-forming substrate is sandwiched between a nozzle plate and an actuator substrate, and these plate and substrates are bonded. The nozzle plate is provided with a plurality of nozzle openings which discharges ink drops. This ink jet head is attached to a head housing. A liquid chamber such as a common liquid chamber or a pressurized liquid chamber, which communicates with the nozzle opening, is formed in the liquid chamber-forming substrate in accordance with each nozzle opening. The actuator substrate includes a pressure generator which changes pressure in the pressurized liquid chamber and a vibration plate which applies deformational displacement by a pressure generator to ink in the pressurized liquid chamber. The pressure in the pressurized liquid chamber is changed by the pressure generator so that the ink drops are discharged from the nozzle opening. On the other hand, the nozzle plate or the vibration plate is made of a metal material such as stainless steel. There is a difference between a linear expansion coefficient of a resin material for use in the liquid chamber-forming substrate and a linear expansion coefficient of a metal material for use in the nozzle plate or the vibration plate. For this reason, the liquid chamber-forming substrate bends due to a change in an environmental temperature or an operation temperature in the ink jet head formed by bonding the nozzle plate, liquid chamber-forming substrate, and vibration plate. An ink jet head described in JP2003-053966A having a configuration which prevents the bending of the liquid chamber-forming substrate is known.

The ink jet head in JP2003-053966A includes a nozzle plate, flow passage-forming substrate, and actuator substrate. The nozzle plate is provided with a plurality of nozzle openings. The flow passage-forming substrate is provided with a weir and a partition. The weir is used to form an ink flow passage including a pressured liquid chamber which is bonded to the nozzle plate to communicate with the nozzle opening, a common liquid chamber to which ink which is supplied to the pressured liquid chamber is supplied, and a flow passage which communicates the pressured liquid chamber and the common liquid chamber. The partition is used to zone the ink flow passage which is formed in accordance with a plurality of nozzle openings, and an ink flow passage in accordance with the adjacent nozzle openings. The weir and the partition are made of a resin material because they require a highly accurate process for forming the pressured liquid chamber and the flow passage. There is a difference between a linear expansion coefficient of the resin material of the weir and the partition and a linear expansion coefficient of the metal material of the nozzle plate and the vibration plate bonded to the weir and the partition. For this reason, the flow passage-forming substrate including the weir and the partition bends in the thickness direction due to a change in an environmental temperature or an operation temperature. In order to control such bending, the rigidity of the flow passage-forming substrate including the weir and the partition is improved by burying a metal plate as a reinforcement material in the resin member of the weir and the partition constituting the flow passage-forming substrate. A phenomenon in which the flow passage-forming substrate bends due to a change in environmental temperature or operation temperature is thereby controlled.

However, the size of the ink jet head in JP2003-053966A is increased for the following reasons because the metal plate is buried in the weir and the partition of the resin material in the flow passage-forming substrate.

An insert-molding method is used for manufacturing the flow passage-forming substrate in which the metal plate is buried in the weir and the partition of the resin material. In order to form the flow passage-forming substrate by the insert-molding method, at first, the metal plate is loaded in an injection-molding mold. A melted resin material is injected in a cavity which is a space between the metal plate and the injection-molding mold provided around the metal plate. After the resin material is set, the flow passage-forming substrate is removed from the injection-molding mold. However, the resin material is not injected when the space between the metal plate and the injection-molding mold provided around the metal plate is narrow, and the weir and the partition in the flow passage-forming substrate may not be formed in sufficient shapes. In order to form the weir and the partition of the flow passage-forming substrate into sufficient shapes, it is necessary to set the space between the metal plate and the injection-molding mold provided around the metal plate to a predetermined size or more such that the melted resin material is sufficiently injected in the cavity. With this configuration, the thickness from the inner wall surface which forms the ink flow passage with the portion of the resin material in the weir and the partition to the surface of the buried metal plate becomes a prescribed thickness or more corresponding to a size which is a predetermined size or more of the space.

In contrast, the size of the metal plate buried in the weir and the partition of the resin material cannot be reduced to be smaller than a predetermined size because it is necessary to ensure the rigidity of the metal plate. Specifically, since it is necessary to control the bending of the ink flow passage in the longitudinal direction, the length of the metal plate in the longitudinal direction which is the same as the longitudinal direction of the ink flow passage cannot be reduced. The thickness of the metal plate cannot be reduced because it is necessary to ensure the rigidity of the metal plate member. As described above, the metal plate is required to be a prescribed size and the thickness of the metal plate cannot be reduced so as to ensure rigidity. A metal plate whose size cannot be reduced to be smaller than a predetermined size is buried in the portion of the resin material in the weir and the partition as described above. For this reason, the size of the flow passage-forming substrate when the metal plate is buried in the resin member is increased to be larger than the size of the flow passage-forming substrate when the metal plate is not buried.

As described above, in the ink jet head in JP2003-053966A, the bending of the flow passage-forming substrate can be controlled by improving the rigidity of the flow passage-forming substrate, but the ink jet head is increased in size.

SUMMARY

The present invention has been made in view of the above problems, and an object of the present invention is to provide a droplet discharge head and an image-forming apparatus which can control the bending of the common liquid chamber-forming substrate while avoiding an increase in size, and an image-forming apparatus.

To attain the above object, one embodiment of the present invention provides a droplet discharge head including a nozzle plate provided with a nozzle opening which discharges an ink drop, an actuator substrate which forms a pressurized liquid chamber communicating with the nozzle opening, and is provided with a pressure generator changing a pressure in the pressured liquid chamber, and a common liquid chamber-forming substrate which forms a common liquid chamber to which ink which is supplied to the pressurized liquid chamber is supplied, the common liquid chamber-forming substrate including a first plate made of a metal material, a second plate made of a resin material provided on one surface of the first plate, and a third plate made of a resin material provided on the other surface of the first plate, and the first plate, the second plate, and the third plate being integrally molded in a thickness direction.

BRIEF DESCRIPTION OF THE DRAWINGS

The accompanying drawings are included to provide further understanding of the invention, and are incorporated in and constitute a part of this specification. The drawings illustrate embodiments of the invention and, together with the specification, serve to explain the principle of the invention.

DETAILED DESCRIPTION OF THE PREFERRED EMBODIMENTS

Hereinafter, one embodiment of a droplet discharge head for use in an ink jet recorder as a droplet discharge device will be described.

Figure 1:
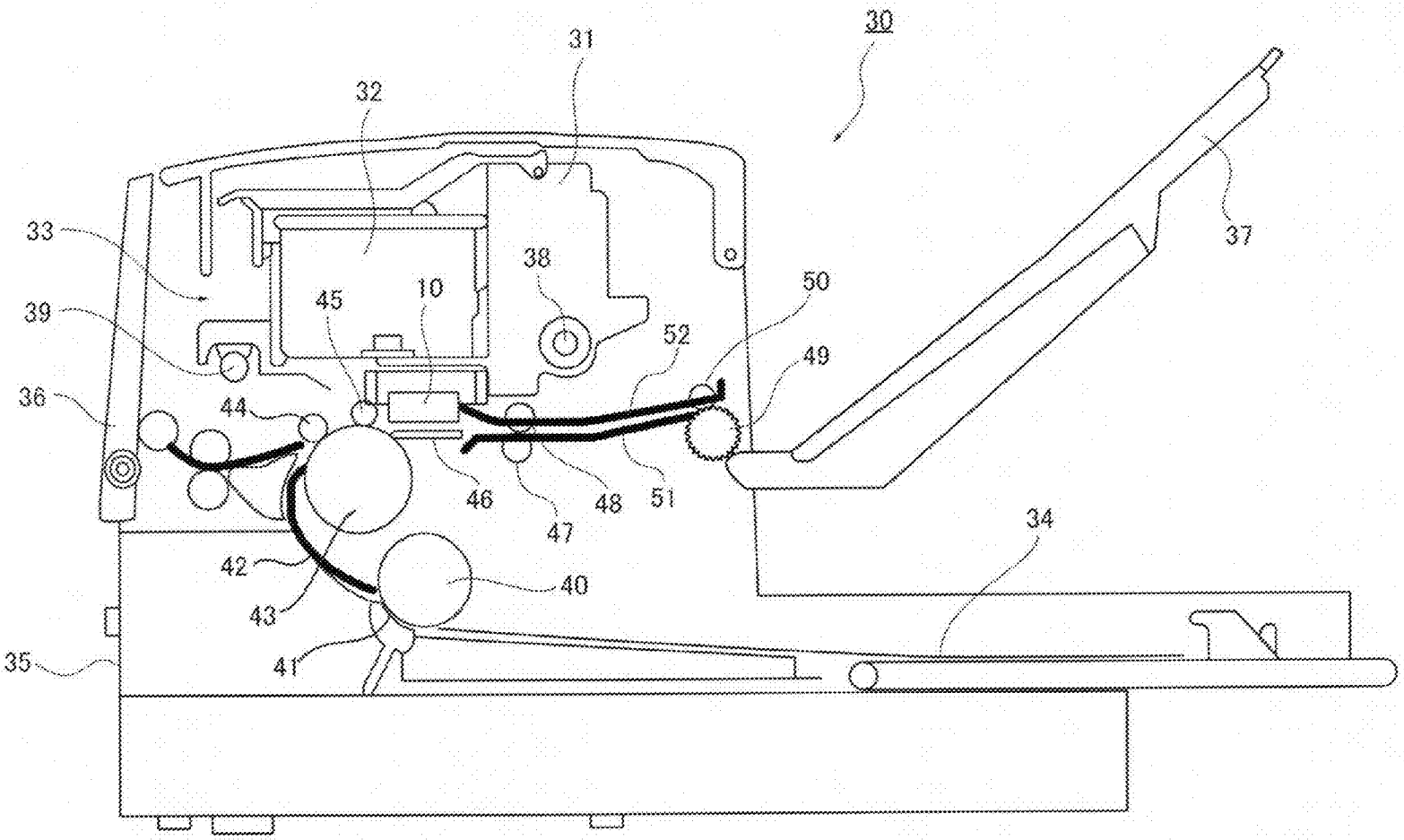
FIG. 1 is a side view illustrating one example of an ink jet recorder equipped with a droplet discharge head.

FIG. 1 is a side view illustrating one example of an ink jet recorder equipped with a droplet discharge head.

An ink jet recorder 30 houses a printing mechanism 33. The printing mechanism 33 includes a carriage 31 which is movable in the scanning direction in the body of the recorder, a droplet discharge head 10 provided in the carriage 31, and an ink cartridge 32 which supplies ink to the droplet discharge head 10. A paper-feeding cassette (or paper-feeding tray) 35 on which many sheets 34 are loaded is provided in the lower portion of the body of recorder to be insertable and removable from the front side. The ink jet recorder 30 includes a manual paper-feeding tray 36 which is opened for manually feeding the sheet 34, and loads the sheet 34 fed from the paper-feeding cassette 35 or the manual paper-feeding tray 36. After recording a required image by the printing mechanism 33, the sheet 34 is discharged on a paper discharge tray 37 provided on the back side of the recorder. In the printing mechanism 33, the carriage 31 is slidably held in the main-scanning direction by a main guide rod 38 which is a guide member bridged between the not-shown right and left side plates and a subordinate guide rod 39. In this carriage 31, droplet discharge heads 10 which discharge ink drops of respective colors of yellow (Y), cyan (C), magenta (M), and black (Bk) are arranged in the direction such that a plurality of ink discharge ports (nozzle) intersect the main-scanning direction. The ink drop discharge direction faces downward. The carriage 31 is provided with respective ink cartridges 32 which supply respective colors of ink to the droplet discharge head 10 in an exchangeable manner. The ink cartridge 32 includes in the upper portion thereof a port which communicates with air and in the lower portion thereof a port which supplies ink to the droplet discharge head 10. The ink cartridge 32 includes inside thereof a porous body in which ink is filled. The ink which is supplied to the droplet discharge head 10 is maintained at small negative pressure by the capillary force of the porous body. The droplet discharge heads 10 of respective colors are used as the droplet discharge heads 10, but one droplet discharge head having a nozzle which discharges ink drops of respective colors can be used.

In this case, the back side (sheet-feeding downstream side) of the carriage 31 is slidably fitted to the main guide rod 38, and the front side (sheet-feeding upstream side) of the carriage 31 is slidably placed on the subordinate guide rod 39. To move and scan the carriage 31 in the main-scanning direction, a not-shown timing belt is extended between a not-shown driven pulley and a not-shown driving pulley which rotate by a not-shown main-scanning motor. The timing belt is fastened to the carriage 31. The carriage 31 reciprocates by the normal and reverse rotation of the main-scanning motor. On the other hand, the paper-feeding cassette 35 includes a paper-feeding roller 40, friction pad 41, guide member 42, carrying roller 43, carrying roller 44, and tip roller 45, so as to feed the sheet 34 set in the paper-feeding cassette 35 to the droplet discharge head 10. The paper-feeding roller 40 and the friction pad 41 separate the sheet 34 from the paper-feeding cassette 35. The guide member 42 guides the sheet 34, and the transfer roller 43 is a roller which turns over the fed sheet 34 to feed the sheet 34. The carrying roller 44 is pressed to the circumferential surface of the carrying roller 43, and the tip roller 45 defines the feeding angle of the sheet 34 from the carrying roller 43. The transfer roller 43 rotates through a gear train by a not-shown sub-scanning motor. An image receiver 46 as a sheet guide member is provided to guide below the droplet discharge head 10 the sheet 34 fed from the carrying roller 43 corresponding to the movable range of the carriage 31 in the main-scanning direction. A carrying roller 47 and a spur 48 which rotate for feeding the sheet 34 in the paper discharge direction are provided on the downstream side of the paper-feeding direction of the image receiver 46. A paper discharge roller 49 and a spur 50 which feed the sheet 34 to the paper discharge tray 37, and guide members 51, 52 which form a paper discharge path are disposed.

In the recording with the ink jet recorder 30 having such a configuration, the droplet discharge head 10 is driven according to image signals while moving the carriage 31. Thereby, ink is discharged to the stopped sheet 34 to record for one minute. After that, the sheet 34 is fed by a predetermined amount, and then, the next recording is performed. By receiving a recording completion signal or a signal indicating that the back end of the sheet 34 has reached a recording area, the recording operation is completed, and the sheet 34 is discharged. A not-shown recovering device which recovers discharge errors of the droplet discharge head 10 is disposed in a position outside the recording area on the right end side of the moving direction of the carriage 31. This recovering device includes a cap, a suctioning device, and a cleaner. This carriage 31 is moved on the recovering device side during printing standby, and the droplet discharge head 10 is capped by the cap to maintain the discharge port 10 in a moistened condition, so that discharge errors due to dried ink can be prevented. By discharging ink without having a relationship with the recording during the recording, the ink viscosity of all of the discharge ports can be maintained, and a stabilized discharge condition can be maintained. When discharge errors occur, the discharge port (nozzle) of the droplet discharge head 10 is sealed by the cap, and air bubbles with the ink are sucked by the suctioning device through a tube. For example, ink or debris to the discharge port surface is eliminated by the cleaner, and discharge errors are recovered. The sucked ink is discharged in a not-shown discharged ink tank provided in the lower portion of the body, and is sucked and maintained in the ink suction body in the discharged ink tank. As described above, the ink jet recorder is provided with the droplet discharge head 10 of the present embodiment, and a stable ink discharge property can be obtained, so that an image quality is improved. Since the ink jet recorder provided with the droplet discharge head was described in the above description, the droplet discharge head can be applied to a discharger of droplets except ink, for example, liquid resist for patterning.

Figure 2:
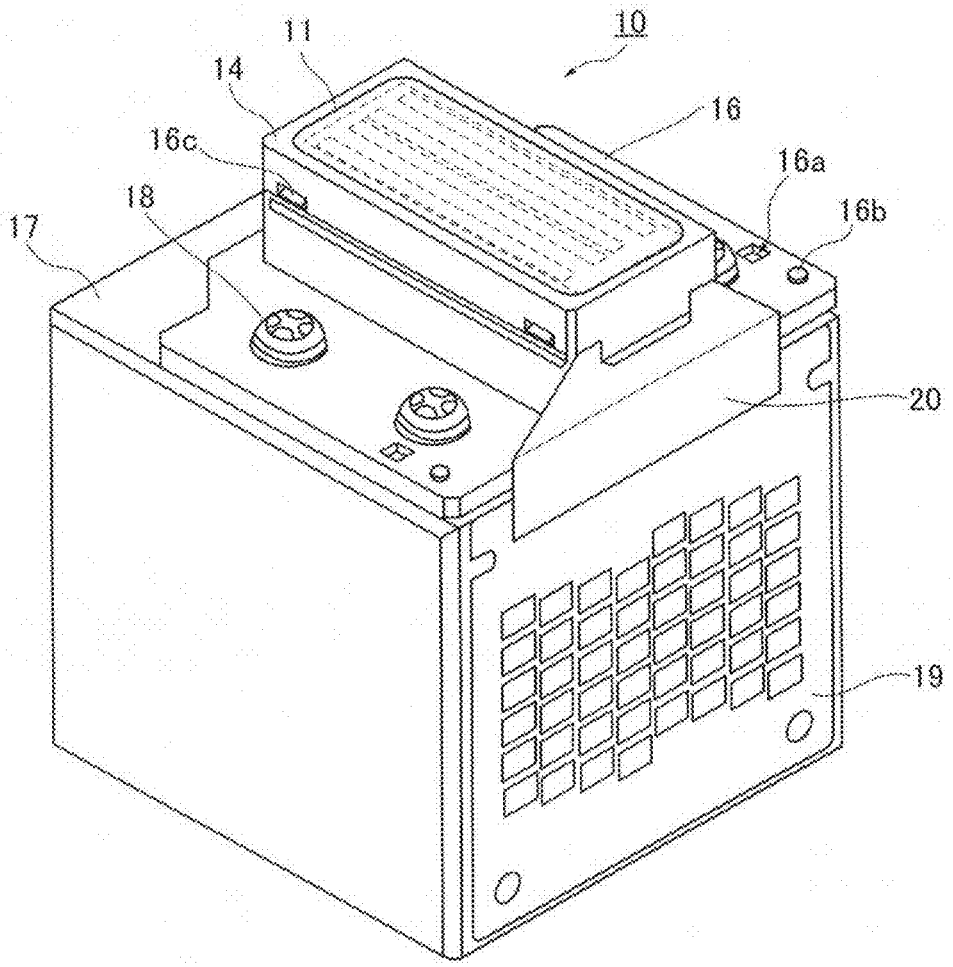
FIG. 2 is a perspective view illustrating the configuration of the droplet discharge head according to an embodiment of the present invention.
Figure 3:
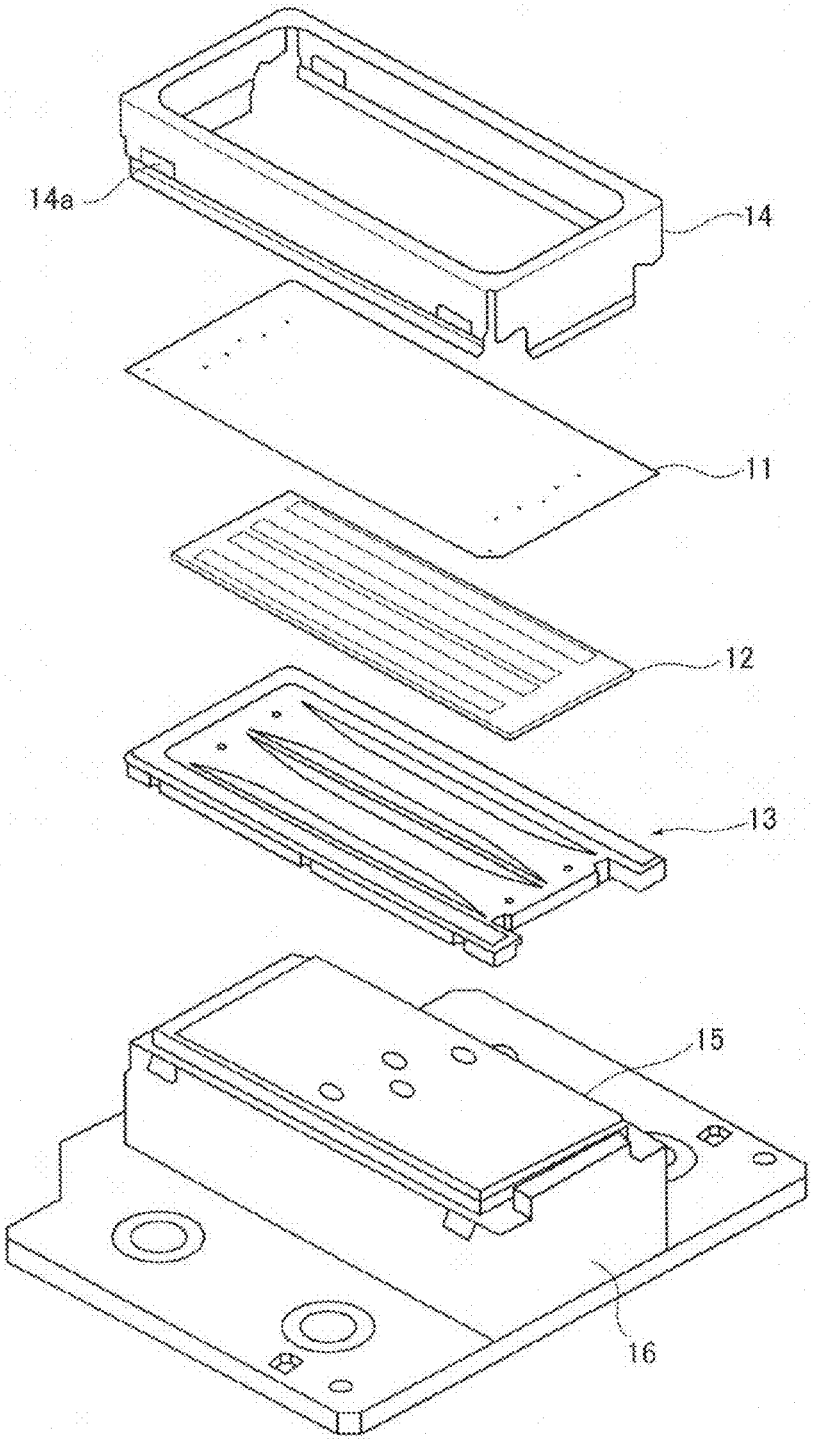
FIG. 3 is an exploded perspective view illustrating the configuration of the droplet discharge head according to the embodiment of the present invention.

FIG. 2 is a perspective view illustrating the configuration of the droplet discharge head of the embodiment of the present invention. FIG. 3 is an exploded perspective view illustrating the configuration of the droplet discharge head of the embodiment of the present invention. The ink jet head 10 as the droplet discharge head of the embodiment of the present invention illustrated in FIGS. 2, 3 includes a nozzle plate 11, actuator substrate 12 and ink flow passage substrate 13 as a liquid chamber-forming substrate. The ink jet head 10 also includes a nozzle cover 14, damper member 15 and housing 16. The nozzle plate 11 is provided with a plurality of nozzle openings (not shown) which discharges ink drops. A plurality of individual liquid chambers (not shown) which supplies ink drops to the nozzle openings is formed in the actuator substrate 12, and a not-shown electric device convertor having a lower electrode, piezoelectric body, and upper electrode is formed on a vibration plate which applies pressure to each individual liquid chamber. The ink flow passage substrate 13 is joined with the actuator substrate 12, so as to form a common liquid chamber, individual liquid chamber and ink supply path. The nozzle cover 14 is provided to expose the nozzle openings provided in the nozzle plate 11, and to cover a circumferential edge portion of the ink jet head. The housing 16 houses a damper member 15, includes position standard portions 16*a*, 16*b* which engage with the after-described carriage 31, and is fixed to a tank holder 17 which holds a plurality of ink tanks (not shown) by a fastener 18 such as a screw.

The ink jet head 10 is provided with a connector substrate 19 having an electric pad which transfers an electric signal according to a recorded image and is electrically connected with a connector disposed in the after-described ink jet recorder 30. The ink jet head 10 is provided with a not-shown driving IC which drives the electric machine convertor provided on the actuator substrate 12 and an FPC 20 which electrically connects a pad electrically connected to a driving IC and the connector substrate 19. The electric signal transferred from the ink jet recorder according to the recorded image is supplied to the electric machine convertor through the connector substrate 19 and the FPC 20. The mechanical vibration converted by the electric machine convertor applies pressure to ink inside the individual liquid chamber through the vibration plate, so that the ink is discharged on a recording sheet from the nozzle opening with a high accuracy.

Four nozzle lines each having a plurality of nozzle holes are formed in the nozzle plate 11 of the ink jet head 10 of the present embodiment. Four-color ink can be discharged from one ink jet head. It is preferable to use a plate member made of stainless steel, for example, as a material of the nozzle plate 11. It is preferable to form the nozzle hole by a pressing method in terms of lowering costs although various methods such as an etching method, laser method or the like are used. The nozzle plate 11 is surface-treated by a lyophobic material, and includes a configuration which prevents discharge errors such as discharge bending of ink due to uneven adhesion of ink. It is preferable to use an organic material including fluorocarbon having a small surface energy as the lyophobic material, and a material which is applied to the surface of the nozzle plate 11 by a vapor deposition method or an immersion method. On the other hand, a process, for example, an oxygen plasma process which is a process of eliminating the lyophobic material is performed on the surface of the nozzle plate 11 which is bonded with the actuator substrate 12, so that the lyophobic material is eliminated. The bonding can be thereby easily made by an adhesive agent applied to the actuator substrate 12. An adhesive agent having a high dissolving resistance to ink for use in the ink jet recorder can be used as the adhesive agent. It is preferable to use a thermal hardening adhesive agent containing epoxy resin or silicon resin.

The nozzle cover 14 opens in the circumferential portion of the nozzle holes formed in the nozzle plate 11. The nozzle cover 14 is bent to form an approximate box shape so as to cover the end surface portion of the ink flow passage substrate 13 and the electric connection of the FPC 20 and the actuator substrate 12. The nozzle cover 14 is provided with a hole 14*a* into which a projection 16*c* provided in the housing 16 is fitted. Stainless steel which is the same as that of the nozzle plate 11 can be used as a material of the nozzle cover 14. The lyophobic material applied on the surface of the nozzle plate 11 is processed to the surface of the nozzle cover 14, so that the adhesion of the ink to the nozzle cover 14 can be controlled.

The electric machine convertor formed in the actuator substrate 12 is finely processed by a semiconductor device manufacturing technique using a sol-gel method, so that the electric machine convertor can be easily densified. A sol-gel method is a method of manufacturing inorganic oxide by hydrolyzing and polycondensing a metal organic component such as metal alkoxide by solution, and growing metal-oxygen-metal bonding, to finally sinter as described in a non-patent document (K. D. Budd, S. K. Dey, D. A. Payne, Proc. Brit. Ceram. Soc. 36, 107 (1985)). The piezoelectric body material which is filmed by the sol-gel method includes lead acetate, isopropoxide zirconium, or isopropoxide titanium as a start material. A material of lead zirconate titanate (PZT) in which these start materials are solved in methoxy ethanol as a common solvent can be preferably used.

Next, the configuration of the ink flow passage substrate will be described.

Figure 4:
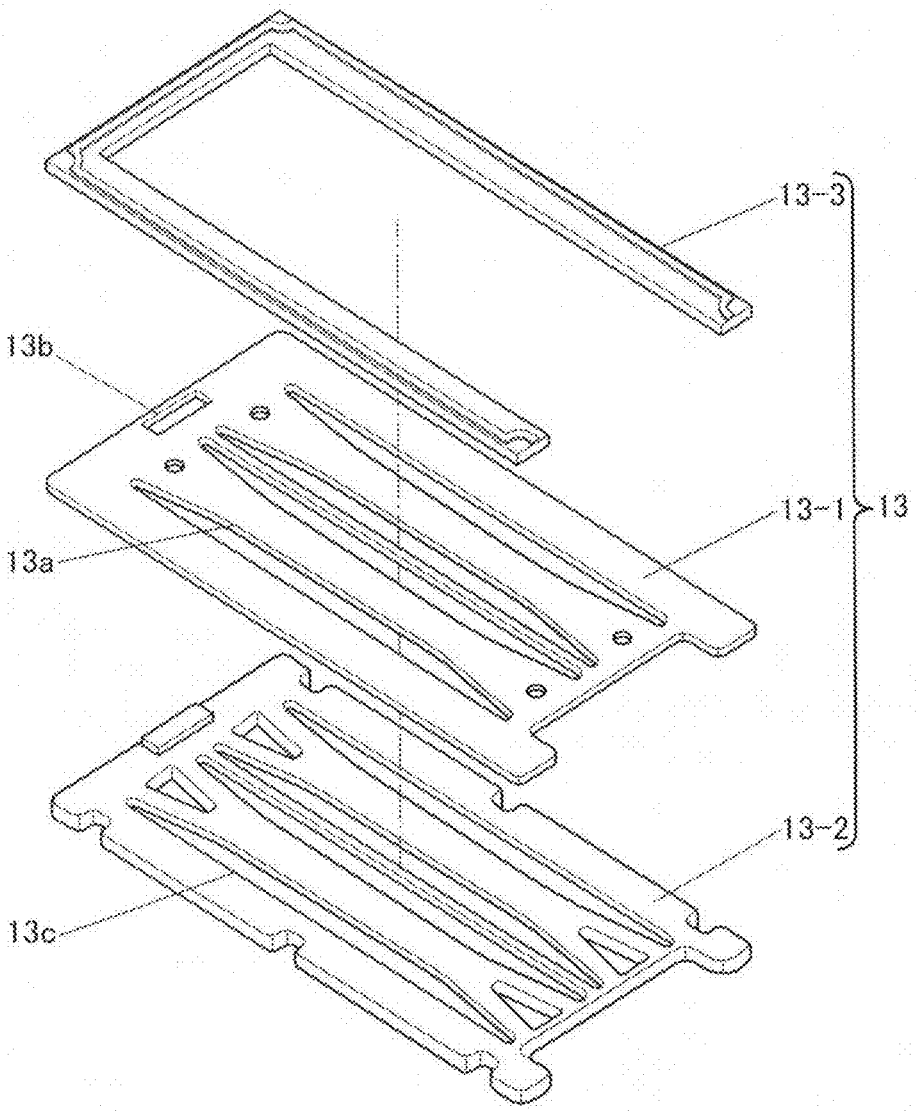
FIG. 4 is an exploded perspective view illustrating the configuration of an ink flow passage substrate.

FIG. 4 is an exploded perspective view illustrating the configuration of the ink flow passage substrate. The ink flow passage substrate 13 illustrated in FIG. 4 is a substrate made by a composite material of a first structure 13-1 made of a metal material, a second structure 13-2, and a third structure 13-3 made of a resin material. The first structure 13-1 includes an opening in a portion where the common liquid chamber 13*a* is formed and an opening, which is formed in addition to that opening, in a portion where a through-hole 13*b* is formed. A melted resin material injected in the injection molding flows in the through-hole 13. The second structure 13-2 is a resin material member, and is disposed in the surface on the damper member 15 side. The third structure 13-3 is a resin material member, and is disposed in the side surface on the actuator substrate 12. The first structure 13-1, the second structure 13-2, and the third structure 13-3 are integrally configured by an insert-molding method. More specifically, a surface process for adhesion with melted resin is previously applied to the surface of the metal member forming the first structure 13-1, and the first structure 13-1 is previously loaded in an injection-molding mold. Melted resin is injected in the injection-molding mold containing the first structure 13-1, so as to form the second structure 13-2, and the third structure 13-3 through the through-hole 13*b*. When removing from the injection-molding mold, the first structure 13-1, second structure 13-2, and third structure 13-3 are firmly adhered to be unified. With such a laminated structure, a heat stress occurring relative to a change in a temperature in molding can be reduced. The flexural deformation of the ink flow passage substrate 13 can be controlled by a change in a temperature such as an operation environment. A process of laminating the second structure 13-2 and the third structure 13-3 relative to the first structure 13-1 by a bonding method such as bonding with an adhesive agent becomes unnecessary, so that the costs can be reduced.

The common liquid chamber is formed in the ink flow passage substrate 13 as illustrated in FIG. 4. However, the common liquid chamber can be formed in the actuator substrate 12 without forming the common liquid chamber in the first structure 13-1. In this case, it becomes unnecessary to form the opening for the partition in the first structure 13-1; thus, the thickness can be reduced, and an increase in size can be controlled. When punching out a metal plate by a pressing method which can reduce a component cost, the thickness of the metal plate is limited based on a relationship of an aspect ratio of the partition and the thickness. For this reason, it was difficult to use the pressing method. However, in this embodiment, the opening for the partition of the common liquid chamber is not formed in the first structure 13-1 when the common liquid chamber is not formed in the first structure 13-1. The first structure 13-1 can be therefore formed by the pressing method. Thus, the component costs can be reduced. Moreover, one surface of the first structure 13-1 is bonded on the actuator substrate 12 side as illustrated in FIG. 4. However, one surface of the second structure 13-2 is bonded on the actuator substrate 12 side. In this case, the pressurized liquid chamber can be formed in the second structure 13-2.

Figure 5:
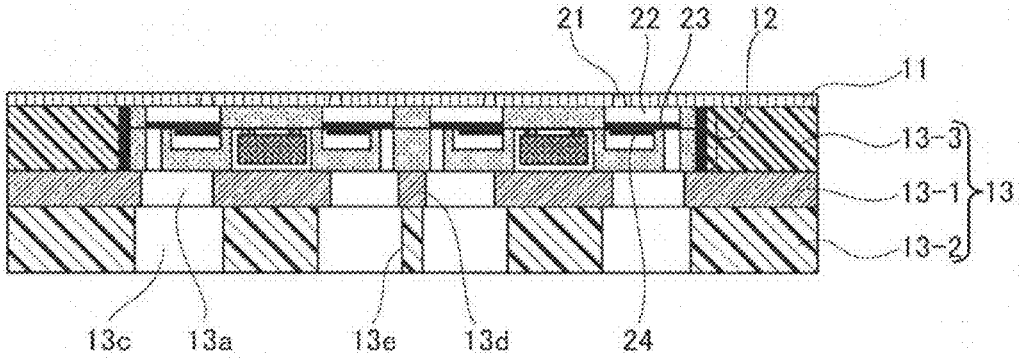
FIG. 5 is a sectional view illustrating an ink flow passage substrate, actuator substrate and nozzle plate in the lateral direction.

FIG. 5 is a sectional view of the ink flow passage substrate, actuator substrate and nozzle plate. It may be necessary to reduce the width of the partitions 13*d*, 13*e* constituting the common liquid chamber in accordance with downsizing and high integration of the ink jet head. In this case, a high rigidity metal plate is used for the first structure 13-1. As a result, the partition 13*e* formed by the resin member is reinforced by the partition 13*d*, so that the ink jet head can be further downsized and integrated. It is preferable to use stainless steel or Fe-42Ni alloy as the metal material of the first structure 13-1. The process method includes various methods such as a pressing method, etching method, wire-cutting method, or laser method. However, it is preferable to use the pressing method in terms of the reduction in costs as described above. It is preferable to use resin containing poly-phenylene sulfide having excellent solvent resistance as the resin material of the second structure 13-2 and the third structure 13-3. The rigidity of the ink flow passage substrate 13 is improved by the resin containing glass fiber. The linear expansion coefficient of the resin member is set to be the same as that of the first structure 13-1, so that the flexural deformation due to a change in temperature can be further controlled. The ink flow passage substrate 13, actuator substrate 12 and nozzle plate 11 are bonded to be provided in a not-shown head holder. Thus, the ink jet head is configured. By bonding the actuator substrate 12 and the nozzle plate 11, an individual liquid chamber which communicates with the nozzle opening 11*a* is formed. In addition, the nozzle plate 11 is provided with a nozzle opening 21, and the actuator substrate 12 is provided with a pressurized liquid chamber 22, vibration plate 23 and piezoelectric body element 24 as a pressure generator.

Figure 6:
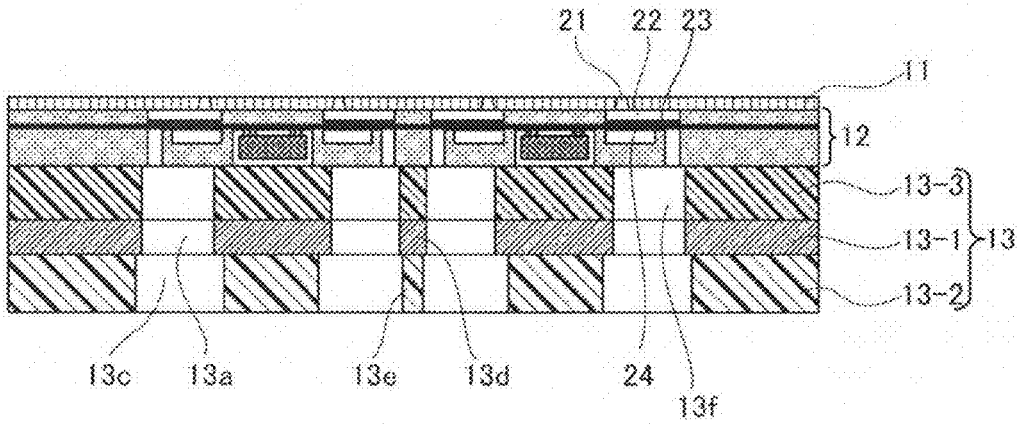
FIG. 6 is a sectional view illustrating a modified example of the ink jet head of the embodiment of the present invention.

FIG. 6 is a sectional view illustrating a modified example of an ink jet head of the present embodiment. In this modified example, the actuator substrate and the third structure 13-3 are bonded, and the opening area of the third structure 13-3 includes inside thereof the actuator substrate 12. Namely, as illustrated in FIG. 6, a common liquid chamber 13*f* is formed to the third structure 13-3, and the actuator substrate 12 and the third structure 13-3 are bonded. As a result, the third structure 13-3 includes a rib function, and the flexural deformation of the actuator substrate 12 can be controlled by the first structure 13-1 and the second structure 13-2 together with the third structure 13-3.

The above description is one example, and the present invention has the following effects on the followings Embodiments.

Embodiment 1

A common liquid chamber-forming substrate includes a first plate made of a metal material, a second plate made of a resin material provided in one surface of the first plate, and a third plate made of a resin material provided on the other surface of the first plate. The common liquid chamber substrate is configured by integrally molding these three plates in the thickness direction. As described above, a required thickness for constituting the common liquid chamber having a required volume cannot be obtained by the thickness of the single first structure 13-1 made of the metal material. In order to cover a thickness which is short on the required thickness, the common liquid chamber-forming substrate is constituted by integrally molding the second structure 13-2 and the third structure 13-3 made of the resin material having the thickness which is short on the required thickness with the first structure 13-1. With this configuration, by obtaining the common liquid chamber-forming substrate having the required thickness, an increase in a size of the ink jet head can be controlled. The second structure 13-2 and the third structure 13-3 are reinforced by the first structure 13-1 having high rigidity. Therefore, the actuator substrate 12 and nozzle plate 11 having a linear expansion coefficient different from that of the common liquid chamber-forming substrate are bonded with the ink flow passage substrate 13. Even when an environmental temperature or an operation temperature change, the bending of the ink flow passage substrate 13 due to a change in environmental temperature or operation temperature can be controlled. Therefore, the bending of the common liquid chamber-forming substrate can be controlled while avoiding an increase in a size.

Embodiment 2

In the above Embodiment 1, the first, second and third plates are integrally molded by an insert-molding method. Accordingly, as described above, the first structure 13-1, second structure 13-2 and third structure 13-3 are firmly adhered to be unified. With this laminated structure, the heat stress occurring relative to a change in a temperature in molding can be controlled, and the flexural deformation of the ink flow passage-forming substrate 13 can be controlled. Consequently, a process of laminating the first structure 13-1, second structure 13-2, and third structure 13-3 by a bonding method such as bonding with an adhesive agent becomes unnecessary; thus, the costs can be reduced.

Embodiment 3

In the above Embodiments 1, 2, one surface of the actuator substrate has contact with the surface of the first plate which is opposite to the surface integrally molded with the second plate. With this configuration, as described in the above embodiment, the flexural deformation of the actuator substrate 12 can be controlled by the rigidity of the first structure 13-1 of the metal material which has contact with the actuator substrate 12.

Embodiment 4

In any one of the above Embodiments 1-3, the surface process is applied to the surfaces in which the resin material and the metal material have contact with each other. Accordingly, as described in the above embodiment, the adhesion of the resin material and the metal material is increased to be further firmly unified.

Embodiment 5

In the above Embodiment 1 or Embodiment 2, the resin material of the second plate is the same as the resin material of the third plate. With this configuration, as described in the above embodiment, the flexural deformation due to a change in temperature can be further controlled.

Embodiment 6

In any one of the above Embodiments 1-5, the resin material is poly-phenylene sulfide. With this configuration, as described in the above embodiment, the solvent resistance of the resin material plate is improved.

Embodiment 7

In any one of the above Embodiments 1-5, the resin material contains glass fiber. With this configuration, as described in the above embodiment, the rigidity of the ink flow passage substrate 13 is improved, and the flexural deformation due to a change in a temperature can be further controlled.

Embodiment 8

In any one of the above Embodiments 1-4, the metal material is stainless steel or Fe-42Ni alloy. With this configuration, as described in the above embodiment, the rigidity of the ink flow passage substrate 13 is improved, and the flexural deformation due to a change in temperature can be further controlled.

Embodiment 9

An image-forming apparatus includes the droplet discharge head according to any one of the above Embodiments 1-8. With this configuration, as described in the above embodiment, ink is discharged on a recording sheet with a high accuracy from the nozzle opening, so that a high-quality image can be formed.

In the embodiments of the present invention, the common liquid chamber can be a space to which ink which is supplied to a normal pressurized liquid chamber is supplied. It is not necessary to form the common liquid chamber only by a resin material as in the pressurized liquid chamber which is required to be processed with a high accuracy because it directly relates to the discharge of the liquid chamber. For this reason, it is not necessary to process a portion forming the common liquid chamber with a high accuracy as in the pressurized liquid chamber. Therefore, the common liquid chamber can be formed by using the first plate. On the other hand, when forming the common liquid chamber by a single first plate made of a metal material, the first plate is formed by punching out respective components from one metal plate by a pressing process. In this case, the distance between the components to be punched out is minimized for punching out many components from one metal plate, so that the productivity is improved. Accordingly, the thickness can be controlled based on the relationship of the aspect ratio, which is the ratio of the thickness and the distance between the components to be punched out. When the distance between the components to be punched out becomes smaller than the thickness, the accuracy of the processed products by the pressing process may not be ensured. As a result, it becomes difficult to increase the thickness of the first plate made of the metal material. Therefore, for the purpose of obtaining a common liquid chamber having a required volume, the number of the first plates to be laminated is increased to ensure a target thickness. Due to such an increase in the number of plates to be laminated, the number of bonded surfaces is increased, and the number of assembling processes such as positioning is also increased.

Consequently, a target thickness for forming the common liquid chamber having a required volume cannot be obtained by a thickness of a single metal plate. In order to cover a thickness which is short on the target thickness, the second and third plates made of a resin material having the thickness which is short on the target thickness are integrally molded with the first plate made of a metal material in the thickens direction so as to form the common liquid chamber-forming substrate. With this configuration, the target thickness of the common liquid chamber-forming substrate can be obtained, and an increase in the size of the ink jet head can be controlled. By constituting the common liquid chamber-forming substrate in which the first plate made of a metal material, the second plate made of a resin material and the third plate made of a resin material are integrally molded in the thickness direction, the second and third plates are reinforced by the first plate having a high rigidity. Therefore, the actuator substrate and the nozzle plate which have a liner expansion coefficient different from that of the common liquid chamber-forming substrate, and the common liquid chamber-forming substrate are bonded. The bending of the common liquid chamber-forming substrate due to a change in an environment temperature or a change in an operation temperature can be thereby controlled. Therefore, an increase in the size of the common liquid chamber-forming substrate can be avoided while controlling the bending of the common liquid chamber-forming substrate.

Although the embodiments of the present invention have been described above, the present invention is not limited thereto. It should be appreciated that variations may be made in the embodiments and the aspects described by persons skilled in the art without departing from the scope of the present invention.

What is claimed is:

1. A droplet discharge head comprising:

a nozzle plate provided with a nozzle opening which discharges an ink drop;

an actuator substrate which forms a pressurized liquid chamber communicating with the nozzle opening, and is provided with a pressure generator changing a pressure in the pressured liquid chamber; and a common liquid chamber-forming substrate which forms a common liquid chamber to which ink which is supplied to the pressurized liquid chamber is supplied, the common liquid chamber-forming substrate including:

a first plate made of a metal material;

a second plate made of a resin material provided on one surface of the first plate; and a third plate made of a resin material provided on the other surface of the first plate, and the first plate, the second plate, and the third plate being integrally molded in a thickness direction, wherein one surface of the actuator substrate has contact with a surface of the first plate which is opposite to a surface integrally molded with the second plate.

2. The droplet discharge head according to claim 1, wherein the first plate, the second plate, and the third plate are integrally molded by an insert-molding method.

3. The droplet discharge head according to claim 1, wherein a surface process is applied to surfaces in which the resin material and the metal material have contact with each other.

4. The droplet discharge head according to claim 1, wherein the resin material of the second plate is the same as the resin material of the third plate.

5. The droplet discharge head according to claim 1, wherein the resin material is poly-phenylene sulfide.

6. The droplet discharge head according to claim 1, wherein the resin material contains a glass fiber.

7. The droplet discharge head according to claim 1, wherein the metal material is stainless steel or Fe-42Ni alloy.

8. An image-forming apparatus including the droplet discharge head according to claim 1.

9. A droplet discharge head, comprising:

a nozzle plate including a nozzle opening to discharge an ink drop;

a first substrate to pressurize a first chamber communicating with the nozzle opening, the first substrate including a pressure generator to change a pressure in the first chamber; and a second substrate at a second chamber to supply ink to the first chamber, the second substrate including:

a first plate including a metal material;

a second plate including a resin material on a surface of the first plate; and a third plate including a resin material on another surface of the first plate, wherein the first plate, the second plate, and the third plate are integral, wherein one surface of the first substrate contacts a surface of the first plate which is opposite to a surface of the first plate which contacts the second plate.

10. The droplet discharge head according to claim 9, wherein the first plate, the second plate, and the third plate are integrally molded by an insert-molding method.

11. The droplet discharge head according to claim 9, wherein a surface process is applied to surfaces in which the resin material and the metal material have contact with each other.

12. The droplet discharge head according to claim 9, wherein the resin material of the second plate is the same as the resin material of the third plate.

13. The droplet discharge head according to claim 9, wherein the resin material comprises poly-phenylene sulfide.

14. The droplet discharge head according to claim 9, wherein the resin material comprises a glass fiber.

15. The droplet discharge head according to claim 9, wherein the metal material comprises stainless steel or Fe-42Ni alloy.

16. An image-forming apparatus including the droplet discharge head according to claim 9.

* * * * *